US005483900A

United States Patent [19]

Elzenbeck

[11] Patent Number: 5,483,900

[45] Date of Patent: Jan. 16, 1996

[54] TABLE MADE WITH INTERCONNECTED PARTS

[75] Inventor: Manfred Elzenbeck, Steinheim/Murr, Germany

[73] Assignee: Froscher Aspect GmbH & Co. KG, Steinheim/Murr, Germany

[21] Appl. No.: 838,276

[22] PCT Filed: Sep. 6, 1990

[86] PCT No.: PCT/EP90/01494

§ 371 Date: Mar. 13, 1992

§ 102(e) Date: Mar. 13, 1992

[87] PCT Pub. No.: WO91/03966

PCT Pub. Date: Apr. 4, 1991

[30] Foreign Application Priority Data

Sep. 16, 1989 [DE] Germany ..... 89 11 083.8 U

[51] Int. Cl.[6] ..... A47B 57/00

[52] U.S. Cl. ..... 108/64; 108/157

[58] Field of Search ..... 108/157, 159, 108/153, 64, 111, 180, 192, 193

[56] References Cited

U.S. PATENT DOCUMENTS

| | | | |
|---|---|---|---|
| 1,668,909 | 5/1928 | Janes | 108/159 |
| 3,533,363 | 10/1970 | Reiss | 108/153 |
| 3,741,852 | 6/1973 | Keener | 108/153 X |
| 4,559,877 | 12/1985 | Waibel | 108/64 |
| 4,706,576 | 11/1987 | James | 108/111 |
| 4,772,018 | 9/1988 | Inniger | 108/64 X |

FOREIGN PATENT DOCUMENTS

| | | | |
|---|---|---|---|
| 2584584 | 1/1987 | France | 108/153 |

*Primary Examiner*—Jose V. Chen

*Attorney, Agent, or Firm*—Jones, Tullar & Cooper

[57] ABSTRACT

In order to be able to combine different types and sizes of tables with the help of as few as possible individual elements, it is proposed in connection with a table with a table top inserted into a frame that the frame consists of corner pieces each forming a corner frame, and of frame rails connecting two corner pieces each, where a removable table leg is associated with each corner piece, the table top is supported at least on one frame rail and the upper surface of the table top extends approximately flush with the top of the frame.

17 Claims, 7 Drawing Sheets

FIG. 4
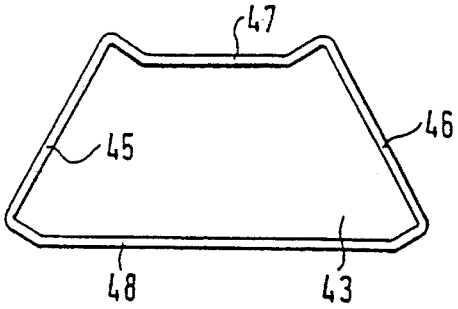
FIG. 6
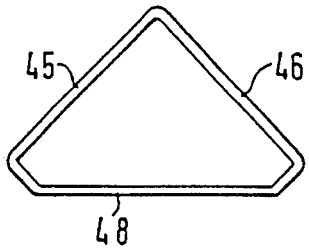
FIG. 7
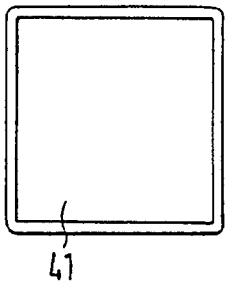
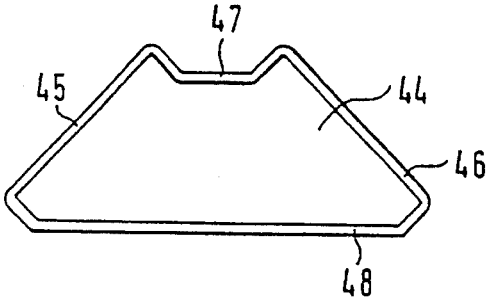
FIG. 5
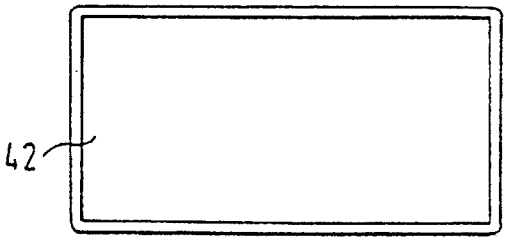
FIG. 8
FIG. 13
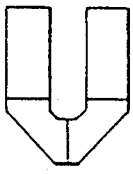
FIG. 9
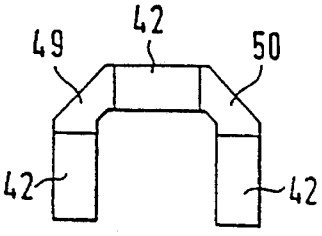
FIG. 11
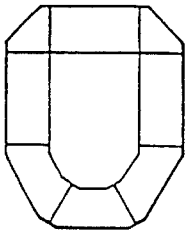
FIG. 14
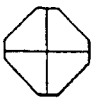
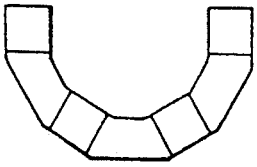
FIG. 10
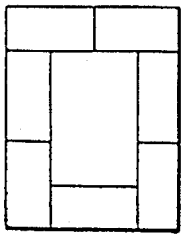
FIG. 12
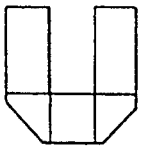
FIG. 15

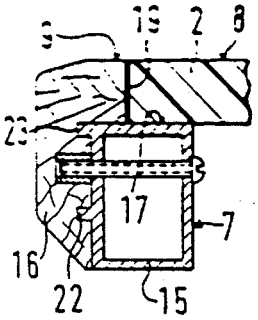
FIG. 25
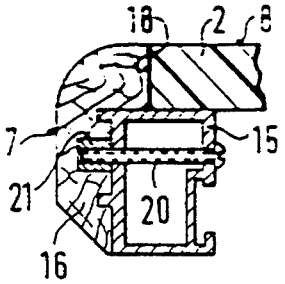
FIG. 26
FIG. 28
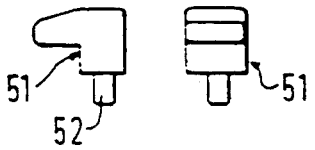
FIG. 27
FIG. 29
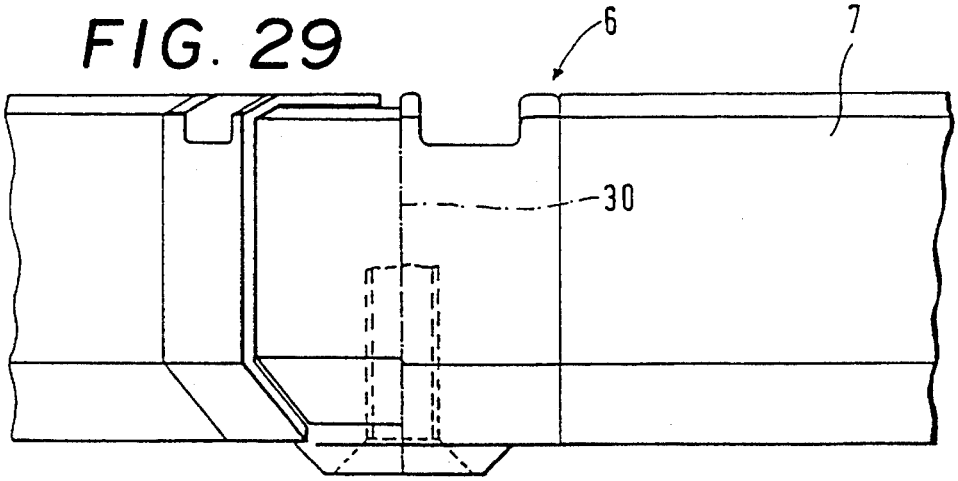
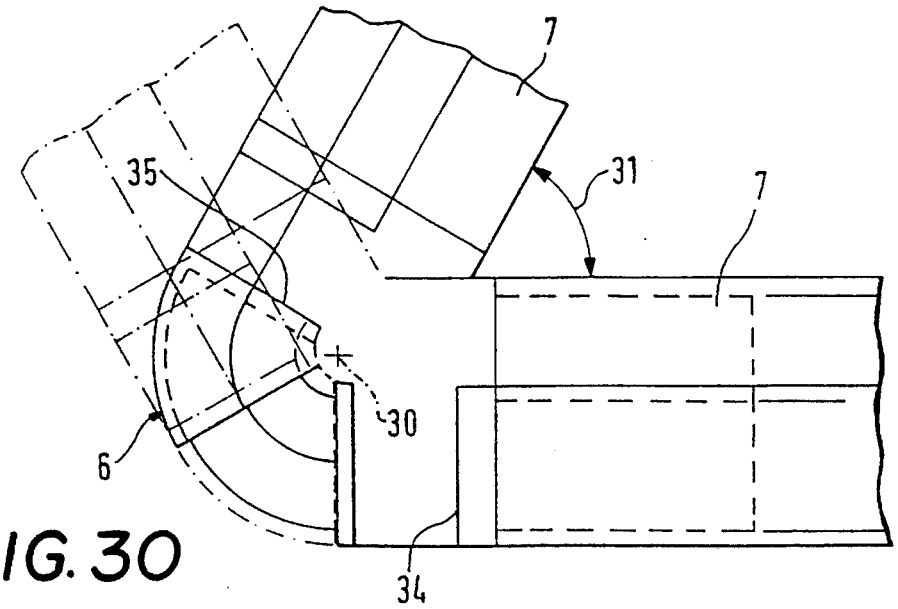
FIG. 30

TABLE MADE WITH INTERCONNECTED PARTS

DESCRIPTION

The invention relates to a table with a table top inserted into a frame, where the frame consists of corner pieces, each forming a corner frame, and frame rails connecting each two of the corner pieces, where a removable table leg is associated with each corner piece, the table top is supported on at least one frame rail, and the upper surface of the table top extends approximately flush with the top of the frame, where furthermore the rail height is reduced step-like at the inside of the frame and the table top rests on the reduced rail section, where the height of the frame step approximately corresponds to the thickness of the table top. Such a table has become known from EP-A-0 198 610. If there the individual table is enlarged or even is to be made into an extended table, this is only possible in that at least one incomplete, as it were, table having only two legs is attached in an extension of the table. Thus a frame having three rails and two legs is required for each additional table top. Therefore this structure is only suitable for making a table longer, not for making extended tables of arbitrary shape. It also has not been provided to insert a leaf without legs between two individual tables. However, the latter is possible in EP-A-0 332 096. But it is considered disadvantageous in connection with this table that the frame rail must be welded together and this frame is placed on the four corner pieces of the individual table, to each of which a leg has been assigned. This frame construction is more expensive than the pluggable one of the first mentioned EP-A. Added to this is that with the table according to EP-A-0 332 096 it is necessary to place the table top on the frame. Protection of the table edges is not possible in this way.

In the table according to EP-A-0 198 610, the table top can be placed inside the frame, but only the two long edges are protected by the frame. However, in a table of a different type (DE-B-1 125 608) it is already known to reduce the frame rails in the form of steps on the inside of the frame and in this way to house the table top inserted in the frame and preferably flush at the top. In this case this is a table glued together, in particular a desk, which does neither permit a building block method nor an enlargement, if necessary.

Thus it is the object to improve a table of the above mentioned type in such a way that it can be used selectively as an individual table or an extended table while being simple to construct and having a visually advantageous look, where there are for all practical purposes no limits regarding the shape of the extended table and where the use of legless leaves is possible.

To attain this object it is proposed by the invention that the table in accordance with the preamble of claim 1 is embodied in accordance with the characterizing part of this claim. This table fulfills the demands made on it. It is always possible to house its table top inserted and thus protected in a frame, regardless of whether it is an individual table or an extended table made of at least two individual tables or of individual tables and at least one leaf. If more than one individual table is required, it can quickly be enlarged by at least one further individual table or by at least one further individual table and a leaf, while the individual elements of the extended table can be securely connected by means of connecting members. This connection can be made quickly and, if needed, can also be undone.

Because each corner piece has two receptacles for a connecting element each placed at an angle to each other, it is possible to assign each angle leg an angle leg of another corner piece and then releasably connect these two angle legs by means of a connecting member. In this way it is theoretically possible to assign two corner pieces to one corner piece. But particular importance is lent to the two receptacles of a corner piece because of the fact that this "extension" of this individual table can be selectively assigned to the one or the other rail of this corner.

Furthermore, based on this frame construction in the manner known from the table which constitutes the species, it is possible to provide tables of different length by the use of rails of different length. Because the table top is protectively placed in the frame it can be made of delicate materials. It is therefore easily possible to use table tops of glass, stone, wood, plastic and similar materials. Because of the detachable legs and the removable table top there are no problems during shipping and packing. Because the legs are detachable, they can easily be exchanged for other ones.

The size of the table top is not determined by the interior clearance of the frame, instead it is larger in the longitudinal as well crosswise direction by the width of the step—measured in the horizontal direction—than the interior clearance of the frame. If it is intended that the table top should end flush with the frame at the top and be placed on support elements, this must be correspondingly considered in connection with the thickness of the table top, if the step-like reduction of the rail height has a preset size. For practical purposes the receptacle of the corner pieces is selected to be rectangular, so that a rectangular table top can be inserted, which can be manufactured more cost-effectively than a table top with rounded corners.

Particular embodiments of the rails are described in claims 5 to 12.

In a very advantageous manner the corner piece can be provided with a female thread, and a corresponding male thread is placed on the associated upper leg end, where the corner piece has on its underside a particularly conically tapering lug, in which the female thread terminates and which slightly protrudes over the lower plane of the frame. The leg can be unscrewed for shipping or if the table is not needed, because of which its space requirements are reduced. On the other hand, this connection between frame and legs speeds up the manufacture of the table. These lugs can be used as spacers when the tables are stacked after removal of the legs.

In a preferred embodiment of the invention the table leg is embodied conically on its upper end associated with the lug of the corner piece, where the cone of the leg engages a conical receptacle of the lug. In this way the leg is centered and held secured against rocking.

As a rule, tables, in particular tables for offices, schools and the like, are rectangular or square. In this case corner pieces are used which automatically assure a right-angled association with adjoining frame rails. However, there are also requirements for other table shapes, in particular if such a table is intended to be placed directly next to a table with the same or a different shape in order to achieve a quite particular shape of the entire table. To do justice to such requirements, too, a preferred variant of the invention provides that the corner piece is embodied in the form of a corner hinge with a hinge axis extending perpendicular to the plane of the table, the two legs of the hinge enclosing an angle of approximately 60° to approximately 180°. If the legs of this corner piece form a 90° angle with each other, this corner piece can be used for providing a frame for a rectangular or square table. If it is intended to make the table pentagonal, hexagonal or of other shapes, the angle enclosed by the two legs is selected to be correspondingly greater. With three corner pieces, each set to 60°, the formation of a triangular frame for a table with three legs is possible. But the corner pieces of a frame need not all be set at the same angle. These corner pieces can also be used for a table with no regular multi-cornered shape.

Another preferred embodiment of the invention ensues from claim 18. As already mentioned it is possible—in the normal case with equal table heights—to place a plurality of tables next to each other in order to obtain an extended table. If two individual rectangular tables are used, the extended table has eight legs. In accordance with the embodiment of claim 18, however, it is possible to create an extended table with the help of two individual tables and a leaf without legs inserted between them, which is larger by the area of the leaf than the total area of the two individual tables, but which only has a total of eight legs when two four-legged individual tables are used. It is advantageous to embody the leaf in the same way as the two table tops. Because of this, the production of individual parts, in particular of corner pieces, is increased, and cost-effective production is attained by mass production.

Because the leaf does not have legs of its own, its weight must be supported by the adjoining individual tables. Transfer of this force of weight takes place via the connecting members or at least one connecting member between each individual table and the leaf. The connecting members provide a direct connection between adjoining frame rails.

If two individual tables of at least the same width are connected with each other via a leaf, it is practical as a rule to choose the width of the leaf to be the same as that of the individual tables. On the other hand, the two individual tables must not absolutely have the same measurements, for example the same width, and the adjoining rails of the individual tables and the leaf also need not be of the same length. However, if the adjoining rails of an individual table and of the leaf are chosen with the same length, the two connecting members can be advantageously associated with the corner pieces, i.e. adjacent corner pieces can always be connected with each other via the intermediate members. In this case the additional connection of the rails is not required. On the other hand, though, this does not necessarily mean that the connecting members must be associated with the corner pieces.

A further embodiment of the invention ensues from claim 12. Attachment of the connecting members to the leaf is given preference over the attachment to the frames of the individual tables. The connecting members each must be fixedly connected with their frames, while their hooks are only suspended from above in the associated receptacle of the other frame. No additional fixed connection is required there, because the hooks are firmly pressed into the receptacles by the weight of the frame and top to be suspended. Otherwise the receptacles must be embodied in such a way that lateral yielding is impossible either in the longitudinal direction of the connecting members or crosswise thereto.

A further variant of the invention ensues from claim 13. It permits the attachment of a leaf to each rail of the individual table. By means of this a universal table system is achieved, which makes many variants possible.

A further embodiment of the invention is characterized by a plug with fastening pegs, which can be inserted into the through-bore of the corner piece and which closes off the associated cutout for a connecting element in the corner piece flush with the exterior, while the step-like recess of the corner piece for receiving the corner of the table top remains free.

Another advantageous embodiment of the invention ensues from claim 17. It permits lateral attachment of a leaf to an individual table where the associated or adjoining rails of the leaf and the individual table are of different length. One connection of the two rails can be provided in the area of the corner pieces associated with each other, while the second connection takes place in the area of the other corner piece and of the cutout disposed on a fixed location of the rail. This is an additional cutout, i.e. one or at least one cutout is located not only on this rail, but also on the two associated corner pieces.

For example, in order to be able to support two leaves, which are disposed next to each other and which directly adjoin each other, on one long side of a rectangular table, a further embodiment of the invention is characterized by two cutouts in the frame rail, the lateral distance of which corresponds to approximately twice the distance of a cutout of the corner piece from the outer edge of the corner piece. In the example mentioned, the two frame rails, which are placed one in the extension of the other, of the two leaves may together have the same length as their associated longitudinal rail of the individual table.

To avoid special shapes of the rails, a further embodiment of the invention provides that the two cutouts are located on a center section of a rail consisting of three rails which can be rigidly connected with each other. This center rail section, in particular provided with two cutouts, in principle corresponds to a corner piece with only the difference that in place of two angled connections it has two parallel ones.

To make possible special shapes of an extended table, for example a horseshoe shape or a special round shape, a further variant of the invention provides that at least one of the rails has the shape of a bow. For example, it can be constructed of three rigidly connected partial sections or in one piece. The idea in particular is to use a table top which in plan view is approximately C-shaped. In this case the bow-shaped rail is associated with a table edge of the same shape. The other rails can extend in a straight line. It is also conceivable that in a further embodiment of the invention two parallel rails each have a bow-shaped form, these bows being disposed parallel. In this connection "parallel" is understood to be a disposition where the center sections of the bows extend parallel to each other and the legs of the bows each point in approximately the same direction. The connection of the right with the left ends of the legs of the bows can take place by means of a straight rail.

Particularly varied shapes of extended tables can be put together by the corner piece embodied as a corner hinge, consisting of two essentially equal parts which can be displaced around the hinge axis in respect to each other, having set-off legs and a threaded bore which is concentric in respect to the hinge axis or a through-bore for the threaded stem of the leg. In this way it is possible to set practically arbitrary angles at the corner hinges, in which case of course the table tops can be irregular polygons having the corresponding angles.

For assembly, the portions of the corner piece embodied as a hinge can each be partially inserted in the frame rail and for locking there they can be divided into two partial legs which can be resiliently spread apart by means of a spreader screw.

Attachment of side tables at practically arbitrary locations can be made possible in that at least a portion of the rails have on at least one side a longitudinal groove which in cross section is undercut and in which a connecting member is displaceably guided, the connecting member supporting the free end of a rail of a leaf. Connection at an arbitrary angle can be achieved in a particularly advantageous manner in that the connecting member has a partial leg pivotable around a perpendicular hinge axis, where in an advantageous manner this partial leg also can be split into two parts which can be resiliently spread apart by means of a spreader screw so that in this way they are securely fixed in the end of the rail.

To be able to insert a connecting member at an arbitrary location of the rail having a longitudinal groove, a guide member displaceable in the longitudinal groove can be made of two parts, divided perpendicular to the hinge axis, where these two parts can then be individually introduced through the opening of the undercut longitudinal groove and can then be pushed on each other and then kept together by means of a screw or the threaded stem of a leg.

In a practical manner the screw holding the two parts together can be used simultaneously as the hinge for the partial leg which is adjustable around the hinge axis. For this purpose the partial leg can have two guide protrusions, which are received towards the interior in receiving grooves of the two parts of guide element, where these guide protrusions are preferably embodied rotationally symmetrical in respect to the axis of rotation.

Additional embodiments of the invention ensue from further dependent claims.

The invention will be described in detail by means of the attached drawings. The drawings illustrate various exemplary embodiments of the invention. In this connection are shown in:

FIG. 1 a lateral view of the table,

FIG. 2 a plan view of the table,

FIG. 3 a lateral view of the narrow side of the table,

FIGS. 4 to 8 plan views of various other shapes of tables in a slightly reduced scale compared to FIG. 2, FIGS. 9 to 15 schematic plan views of extended tables constructed from a plurality of individual tables in even greater reduction, FIG. 16 a fragmentary lateral view in the area of a table leg in an enlarged scale, FIG. 17 a fragmentary lateral view, partially cut in a perpendicular direction, of the table of FIG. 16, FIG. 18 a plan view of the table corner shown in FIG. 16, FIG. 19 a fragmentary front view of a cover with an associated leg end, FIG. 20 a plan view of FIG. 19, FIG. 21 a cross section of the corner piece, FIGS. 22 to 26 various embodiments of the table frame in cross section, FIG. 27 a lateral view, and FIG. 28 a front view of a plug installed in place of the connecting piece shown in partial section in FIG. 21, FIG. 29 a front view of a corner of the frame in the corner hinge in enlargement, FIG. 30 a plan view of FIG. 29 in another swiveled position of the corner binge, FIG. 31 a partial view of a connecting piece settable at an angle, FIG. 32 is a schematic view showing different angular positions of the corner hinge, FIG. 33 is a schematic view in elevation of a corner hinge configuration, FIG. 34 is a schematic view of two adjacent rails and their connecting member, FIG. 35 is a schematic top view showing different positions of the guide element, FIG. 36 is a cross sectional view of two adjacent rails and their connecting member, and FIGS. 37 and 38 are two embodiments of extended tables.

The table 1 or individual table consists of a frame 1, a table top 2 inserted therein as well of at least three legs 3. However, preferably these are tables with four legs. All legs are removable, they preferably can be unscrewed in the exemplary embodiments. For this purpose they have on their ends which are oriented towards the frame 1 a threaded stem 4 which is screwed into a threaded bore 5 of a corner piece 6 of the frame. The opposite arrangement is also conceivable, namely the application of a threaded stem on the corner piece and of a threaded bore on the leg.

The frame consists of corner pieces and frame rails 7 inserted between each two corner pieces. Thus the frame of a four-cornered table consists of four corner pieces and four rails. If it is a rectangular table as in the exemplary embodiments 1 to 3, it has two long rails and two short rails. As can be seen in FIGS. 23 to 26, for example, the table top 2 is inserted into the frame in such a way that the surface 8 of the table top extends flush or at least approximately flush with the top 9 of the frame. It can furthermore be seen in these drawing figures that the table top is supported at least on the frame rails, the support being preferably directly on the frame rails. It can be seen in FIG. 18 that by means of the appropriate embodiment of the corner pieces the table top can also be supported on them. This requires that there be a bead 10 running around the inside (FIG. 22), which also extends over the corner pieces and which preferably has the same dimensions in the area of the corner pieces as in the area of the rails. The bead 10 is produced by the rail height 11 being reduced step-like on the inside of the rail or the inside of the frame. The table top 2 rests on the reduced rail piece 12, while the higher rail piece 13 encloses the table top to form the table edge.

If the term "reduced height" is used here, this does not necessarily mean that the rail has been worked, rather than that it can be an appropriately shaped profile as shown by way of example in FIG. 22. From FIGS. 23 to 26 it can be seen that the height of the frame step or bead 10 approximately corresponds to the thickness of the table top or, with a table top of uneven thickness, to the edge of the table top.

It can be seen, for example, from FIGS. 1 and 3 that the height of the frame rails—measured in the perpendicular direction—is equal or at least approximately equal to the height of the corner pieces. This can also be seen for example in the enlarged view of FIGS. 16 and 17. The angled bead 14 of the corner piece 6 (FIG. 18) is indicated by 14.

While the rail 7 in accordance with FIG. 21 consists of solid material, the rail 7 of FIG. 22 is a section of a hollow profile. In contrast thereto the rails of FIGS. 23 to 26 are made in two pieces. The division is provided in the longitudinal direction, i.e. both rail pieces are of equal length. In accordance with FIGS. 23 and 24, the rail is essentially made of a specially shaped hollow profile, for example of aluminum, forming the one rail piece. This rail piece alone is responsible for the stability of the frame 1. The respectively other rail piece 16 of this rail structure primarily has an esthetic effect. It is made of a plastic profile strip, preferably of plasticized PVC. Although in accordance with FIG. 24 the table top 2 of the inside of the frame extends flush with the frame, the outer frame edge of this variant has been raised a little, so that liquids cannot run over the table edge there.

The two rail pieces 15 and 16 of FIGS. 23 and 24 are interlockingly connected with each other, so that even under a somewhat increased load the rail piece 16 cannot separate from the rail piece 17. In these variants the other rail piece 16 has an essentially C-shaped cross section, where each of the ends of the C-shaped legs are embodied hook-like. Each one of these free, hook-like C-shaped legs engages a groove of the one rail piece 15. The two rail sections are pushed one on the other by pushing the smaller strip-shaped rail piece 16 in a longitudinal direction on the larger rail piece 15, which in a practical way is made as an aluminum profile. In accordance with FIGS. 25 and 26, the rail 7 may also be constructed from a metallic hollow profile and a solid profile rigidly connected therewith, where the hollow profile forms the one rail piece 15 and the solid profile the other rail piece 16. It is intended in particular in these two exemplary embodiments for the one rail piece 15 to be an aluminum profile, while the other rail piece 16 is made of wood. In this case the fall 10 is formed by both rail pieces together, while in the embodiments of FIGS. 23 and 24 it is primarily determined by the rail piece 15. In both cases the table top 2 rests on the upwardly oriented surface 17 of the one rail piece 15. The edge 19 of the solid profile or the other rail piece 16, oriented towards the interior of the frame and preferably parallel to the table top edge is, if possible, placed directly in front of the latter.

In the exemplary embodiments of FIGS. 25 and 26, the connection of the two rail pieces 15 and 16 is provided with the aid of a plurality of screws 20, disposed offset in the longitudinal direction, which are screwed into threaded bushings 21. The latter are maintained fixed against rotation in the other rail piece 16, for example pressed in. The screw extends through two bores, aligned with the thread of the bushing 21, in the parallel rail walls of the one rail piece 15.

It can also be seen from FIGS. 25 and 26 that the two pieces 15 and 16 of the rail 16 are interlockingly connected with each other. This can be achieved, for example, by forming two parallel strips 22 and 23 on the hollow profile of the one rail piece 15, which engage in appropriately disposed grooves of the solid other rail piece 16.

By way of example it can be seen from FIGS. 16 and 17 that the corner piece has on its underside a lug 24, particularly tapering conically, in which the female thread 5 terminates on the outside. In the exemplary embodiments this lug extends slightly, i.e. by a few millimeters, beyond the lower plane 25 of the frame.

On its upper end associated with this eye 24 of the corner piece 6, the table leg 3 is embodied conically, this cone being designated by 26. In the exemplary embodiment (FIG. 16), the free cone surfaces and the cone height have been selected to be of different size. It has been provided in particular that the leg cone 26 engages the opposite cone of the lug 24, which widens towards the outside, and is centered in this way and securely maintained.

The lower end of the table leg 3 is also embodied conically, this cone being designated by 27. Preferably at least the cone angles of the two leg cones 26 and 27 are of the same size. The height of the lower cone 27 in FIG. 16 is of approximately the same size as that of the upper cone 26. On the lower end of the leg 3 a female thread 29 which extends centered through the cone 27 is disposed, which extends into the non-reduced cross section of the leg. It is used for screwing in an adjustment leg 29 for the height of the table.

While the corner pieces of the above described variants of the table determine a solid angle for the rails to be connected which, in a preferred manner is a right angle, the corner piece in accordance with FIGS. 29 and 30 is embodied as a type of a corner hinge. The hinge axis 30 extends perpendicular to the plane of the table top 2. In the exemplary embodiment, the angle 31 formed by both legs of this corner piece can be changed over a large range of, for example approximately 60° to approximately 120°.

Each corner piece 6 is equipped with two receptacles 34, placed at right angles to each other, for a connecting member 33. These connecting members, preferably a pair of connecting members, are used for the rigid connection of the table top 2 of the table with a further top, which can be a further table top or a leaf 36 placed between two individual tables, which will be discussed in more detail below. These receptacles 34, 35 in accordance with FIG. 17, for example, are in the form of a longitudinal slot open at the top and side, which is recessed at its inner end in a step-like way. The hook of a connecting member 33 engages this recess. After the connecting member in accordance with FIG. 21 has been connected with the corner piece via a screw 37 or in another known manner, and is furthermore embodied symmetrically in respect to a perpendicular cross center plane, it is sufficient if two connecting members are rigidly mounted on only one of the two associated rails of the two table tops. The free projecting ends, namely the hooks 32, are simply suspended from above at the other table top. This connection is securely maintained by reason of the weight of the suspended table top alone, where it is unimportant whether or not legs have been attached to the suspended table top. It can further be seen in FIG. 21 that the connecting piece extends flush or at least approximately flush with the top of the corner piece 6 and preferably with the top of the entire frame 1. In this way the width and depth as well as the step-like recess of the receptacles 34 and 35 follow the corresponding dimensions of the connecting member 33.

In the exemplary embodiment, the screw 37 is screwed in one of two parallel female threads 38, 39. If the table top with the connecting members is only suspended in the frame of the other table top, the female thread 39 remains unused. On the other hand it would also be possible to make a connection there with the aid of a screw, if all corner pieces are embodied the same and thus each has a receiving bore 40 for the fastening screw.

FIGS. 4 to 8 show that the table top 2 does not necessarily have to be square or rectangular. Four-legged tables are easily conceivable having a roughly C-like shape 43 or 44 deviating from the square shape 41 or the rectangular shape 42. The same corner pieces 6 can be used with the table shapes 43 and 44 as with square or rectangular tables. With these variants the rails 45 and 46 do not extend parallel, but angled, in respect to each other. Additionally, at least one of the rails connecting these two straight rails 45 and 46 with each other is bow- or U-shaped. With the embodiments according to FIGS. 4 and 5 the two rails 47 and 48 have an approximately U shape, where each of the two left and two right legs extend parallel to each other and perpendicular to the associated straight rail 45 or 46.

The table shapes in accordance with FIGS. 4 and 5, but also the approximately triangular table in accordance with FIG. 6, can be parts of an extended table. Different variants of such an extended table ensue from FIGS. 9 to 15. For example, the extended table in accordance with FIG. 9 consists of two tables according to FIG. 5 and three tables according to FIG. 8. In this case it is not necessarily required that the two tables in accordance with FIG. 5 themselves have legs, instead they can be leaves 49 and 50. Their frames are constructed in the same way as the frames of the tables 41, 42 of corner pieces and rails 7 placed between adjacent corner pieces. Furthermore, the table top 2 has been inserted recessed in each one of these frames. The connection between two adjoining tables is made in the manner described above by means of at least two connecting members 33 between adjoining table tops, where each of the connecting elements is advantageously fastened on the leaves 49 or 50.

Whether such an extended table is constructed of a plurality of individual tables with legs or only partly of individual tables and partly of at least one leaf 49, 50, depends on the one hand on the conditions and partially also on the total shape of the extended table. Thus it is recommended in connection with the two lower tables in FIG. 3, for example, to provide at least one pair of legs at least at the ends of the tables facing each other.

If the individual table is not connected with another individual table or with a leaf 49, 50, no connecting members 33 are needed. In this case it is advantageous if the receptacles 34, 35 can be closed off by means of a plug 51 (FIG. 27). It has a fastening peg 52 which allows a pluggable connection with the receiving bore 40 of the corner piece 6. Otherwise the shape of the plug 51 is chosen to correspond to that of the receptacle 34 or 35, so that the plug can completely close off the receptacle in the corner piece 6 and a surface level at the top is created.

If, for example, it is intended to connect a shorter table or the narrow side of another individual table or a leaf 36 in an off-centered way with the long side of an individual table, it is easy to make the connection at this place in the manner described with corner pieces of the two frames which are associated with each other. The other corner piece 6 of the short rail, however, can only be connected with the longer rail via a connecting member, if this rail has a receptacle 34 (FIG. 2) at the associated place, for example in its center area, which corresponds in its design to one of the two receptacles 34, 35 of the corner piece. A particularly advantageous possible for the right angle connection of rectangular tables of, for example, the same size, or of an individual table and a leaf, can be achieved in accordance with FIG. 2, if the longitudinal rail 53 has two receptacles 34, 35 disposed parallel and at a distance from each other. In this way it is possible to associate the second individual table or the leaf 49, 50 either to the rail part which is to the left in FIG. 2 or to the right rail part of the rail 53. Even the connection of the individual table of FIG. 1 with two further individual tables or leaves disposed parallel to each other is conceivable. In FIG. 2 the lateral distance 54 of the two receptacles 34 and 35 is approximately twice as great as the distance 55 of a receptacle 34 or 45 from the outer edge 56 of the corner piece (FIG. 8).

It is now possible to dispose the two receptacles 34, 35 directly on the appropriate rail 53 or create a special straight intermediate piece corresponding to the corner piece 6, so that the rail 53 consists of three parts, namely the intermediate piece, in particular center piece, having the receptacles 34 and 35, and two rail pieces disposed to the left and right thereof. The two free ends of the latter are then each connected with a corner piece 6. The connection of the three rail pieces must assure sufficient load capacity of this rail.

In FIGS. 19 and 20 it can be seen, mostly indirectly, that it is possible to dispose a plate 57 for use as a cover between two adjoining table legs 3. Its perpendicular length facing the leg 3 encompasses the respective leg from the inside to the outside in accordance with FIGS. 19 and 20. In the case of a circular cross section of the leg, the long edge is in the shape of an arc of a circle. Because of this the plate can easily absorb forces directed crosswise to its surface. In the exemplary embodiment this perpendicular long edge is not formed directly on the plate, but on a profiled strip 59 fixedly connected with it, for example glued. In a practical manner this is a profiled plastic strip.

In accordance with the illustration of FIG. 19 in connection with FIG. 16, the profiled strip 59 has been provided at its upper and lower ends with a protrusion 60 or 61 in the shape of a barb pointing away from the plate. In this case the upper protrusion 60 overlaps the upper cone 26 of the leg 3 from above, while the protrusion 61 overlaps the lower cone 27 of the leg 3 from below.

In this way the plate 57 is not only securely maintained crosswise to its plane, but also in the perpendicular direction, without special fastening elements. It can be mounted as easily as it can be removed.

A connecting member 33' is shown in FIGS. 31 to 33, which is guided longitudinally displaceable in a longitudinal groove 66 of a rail 7 with a guide element 67. This connecting member 33' is made of several pieces. It consists of the guide element 67 composed of two parts 67', 67" and a partial leg 65 which is partially received in the rail 7 and for fastening is split into partial legs 64 and 64', which can be spread in the rail 7 with the help of a spreader screw 63.

The two parts 67', 67" of the guide element 67 have receiving grooves 69 extending crosswise to the longitudinal groove 66, in which guide protrusions 70 of the partial leg 65, which is spread in this location, are received. The partial leg 65 is pivotable via a screw 68 in respect to the guide element 67 around the pivot axis 30'.

In place of the screw 68 it is also possible to screw in an appropriately embodied threaded stem 4 of a leg 3 to receive the perpendicular load of the rail 7.

Using the connecting members 33' embodied in accordance with FIGS. 31 to 33, it is possible to assemble an extended table composed of a plurality of table tops 2 and leaves 49, 50 in practically any arbitrary shape, as illustrated in FIGS. 37 and 38. It is then possible to embody the table tops 2 or the leaves 49, 50 in an appropriate polygonal shape and the required frames 7 can be adapted. By means of the embodiment of the corner pieces 6 as hinges or with the connecting members 33', which can be set at an angle, practically any shape for the extended table can be realized, and only a few different individual parts are required.

I claim:

1. A table, comprising:

a frame including a plurality of rails and a plurality of corner pieces joined to the plurality of rails;

a leg removably associated with each corner piece; and a table top having a top surface and a recess engaging portion, wherein:

each rail consists of a pipe-shaped hollow profile; and each rail and corner piece defines a top surface and each corner piece and at at least two facing rails are formed with a step-like recess of equal height, such that when the rails and corner pieces are assembled as a frame, at least two parallel, continuous step-like recesses are formed which receive the corresponding recess engaging portions of the table top so that the top surface of the table top is flush with at least a portion of the top surface of the assembled rails and corner pieces.

2. A table, comprising:

a frame including a plurality of rails and a plurality of corner pieces joined to the plurality of rails;

a leg removably associated with each corner piece; and a table top having a top surface and a recess engaging portion, wherein:

each rail and corner piece defines a top surface and each corner piece and at at least two facing rails are formed with a step-like recess of equal height, such that when the rails and corner pieces are assembled as a frame, at least two parallel, continuous step-like recesses are formed which receive the corresponding recess engaging portions of the table top so that the top surface of the table top is flush with at least a portion of the top surface of the assembled rails and corner pieces;

each corner piece is provided with a female thread upper end of each associated leg is provided with a corresponding male thread; and each corner piece has on its underside a particularly conically tapering lug in which the female thread terminates outwardly, said lug slightly protruding over the lower surface of adjacent rails.

3. A table in accordance with claim 2, further wherein each said lug includes a conical receptacle, each table leg is embodied as a cone on its upper end associated with said lug of the corner piece, and wherein the cone of the leg engages the conical receptacle of said lug.

4. A table in accordance with claim 3, further wherein each leg includes an adjustment leg portion, the lower end of the table leg is also embodied conically, where the upper and the lower cones are approximately the same and the lower cone is provided with an axial female thread into which the adjustment leg portion can be screwed.

5. A table, comprising:

a frame including a plurality of rails and a plurality of corner pieces joined to the plurality of rails;

a leg removably associated with each corner piece; and a table top having a top surface and a recess engaging portion, wherein:

each rail and corner piece defines a top surface and each corner piece and at at least two facing rails are formed with a step-like recess of equal height, such that when the rails and corner pieces are assembled as a frame, at least two parallel, continuous step-like recesses are formed which receive the corresponding recess engaging portions of the table top so that the top surface of the table top is flush with at least a portion of the top surface of the assembled rails and corner pieces;

at least one corner piece is embodied as a kind of a corner hinge with a hinge axis extending perpendicular to the table plane; and the two legs of the hinge extending from said hinge axis preferably enclose an angle of approximately 60° to approximately 120°.

6. A table, comprising:

a frame including a plurality of rails and a plurality of corner pieces joined to the plurality of rails;

a leg removably associated with each corner piece;

a plurality of connecting members;

a plurality of connecting means; and a table top having a top surface and a recess engaging portion, wherein:

each rail and corner piece defines a top surface and each corner piece and at at least two facing rails are formed with a step-like recess of equal height, such that when the rails and corner pieces are assembled as a frame, at least two parallel, continuous step-like recesses are formed which receive the corresponding recess engaging portions of the table top so that the top surface of the table top is flush with at least a portion of the top surface of the assembled rails and corner pieces, and each corner piece has two receptacles disposed at right angles to each other, said receptacles of each corner piece being adapted to receive a connecting member which is connected thereto by one of said connecting means for connecting an assembly of rail and corner pieces to another assembly of rail and corner pieces.

7. A table in accordance with claim 6, further comprising:

a leaf, further wherein:

said leaf is connected to an assembly of rail and corner pieces by at least two connecting members which are connected to the assembly of rail and corner pieces and to said leaf by said connecting means.

8. A table in accordance with claim 7, further comprising:

at least two corner pieces for each leaf, further wherein each connecting member includes a hook, which engages a receptacle disposed in a corner piece of said leaf, and wherein each connecting member is attached to a corner piece of the leaf and the associated receptacle on the corner pieces of said frame of the individual table by said connecting means.

9. A table in accordance with claim 8, further wherein: each corner piece of the leaf and of the frame of the individual table has two receptacles disposed at right angles to each other, the connecting member being provided at both ends with a hook of the same kind, and wherein each receptacle is embodied as a groove open at the top, which is recessed step-like at its inner end for receiving one of the hooks of a connecting member.

10. A table in accordance with claim 9, further wherein: each connecting member extends, at its top, approximately flush with its associated corner piece, and wherein the two rails associated with each corner piece are associated in close proximity with each other.

11. A table in accordance with claims 9 or 10, further wherein: a female thread is located at one end of each hook of each connecting member, and wherein each corner piece has a through-bore extending crosswise to the frame plane for receiving a fastening screw.

12. A table in accordance with claim 7, further wherein at least one cutout is provided for a connecting member on at least one frame rail substantially at the center section of an individual table, said at least one cutout being used with the cutout of a corner piece for fastening a connecting member of a leaf or for receiving a hook of a connecting member.

13. A table in accordance with claim 12, further wherein: the lateral extent of two cutouts of the frame rail, approximately corresponds to twice the extent of a receptacle of the corner piece from the outer edge of the corner piece.

14. A table in accordance with claim 13, further wherein: two receptacles are located on a center section of a rail having three parts.

15. A table in accordance with claim 7, further wherein: at least a portion of the rails have on at least one side a longitudinal groove undercut in cross section, in which a connecting member is displaceably guided, and wherein the connecting member supports the free end of a rail of a leaf.

16. A table, comprising:

a frame including a plurality of rails and a plurality of corner pieces joined to the plurality of rails;

a leg removably associated with each corner piece;

a plate used as a cover located between adjacent table legs, whose perpendicular long edges partially enclose the associated leg from the inside to the outside; and a table top having a top surface and a recess engaging portion, wherein:

each rail and corner piece defines a top surface and each corner piece and at at least two facing rails are formed with a step-like recess of equal height, such that when the rails and corner pieces are assembled as a frame, at least two parallel, continuous step-like recesses are formed which receive the corresponding recess engaging portions of the table top so that the top surface of the table top is flush with at least a portion of the top surface of the assembled rails and corner pieces, and each perpendicular long edge of the table legs is formed by a free long edge of a separately manufactured profiled strip connected with the plate.

17. A table in accordance with claim 16, further wherein the profiled strip has a protrusion on each of its upper and lower ends pointing away from said plate, which overlaps an associated cone at the upper or lower end of the leg from above or below.

* * * * *

UNITED STATES PATENT AND TRADEMARK OFFICE

CERTIFICATE OF CORRECTION

PATENT NO. : 5,483,900

DATED : January 16, 1996

INVENTOR(S) : Manfred Elzenbeck

It is certified that error appears in the above-indentified patent and that said Letters Patent is hereby corrected as shown below:

Delete columns 1-14 and replace with columns 1-16, as shown on the attached pages.

Signed and Sealed this

Twenty-second Day of April, 1997

Bruce Lehman

*Attest:*

BRUCE LEHMAN

*Commissioner of Patents and Trademarks*

*Attesting Officer*

TABLE MADE WITH INTERCONNECTED PARTS

BACKGROUND OF THE INVENTION

The invention relates to a table with a table top inserted into a frame, where the frame consists of corner pieces, each forming a corner frame, and frame rails connecting each two of the corner pieces, where a removable table leg is associated with each corner piece, the table top is supported on at least one frame rail, and the upper surface of the table top extends approximately flush with the top of the frame, where furthermore the rail height is reduced step-like at the inside of the frame and the table top rests on the reduced rail section, where the height of the frame step approximately corresponds to the thickness of the table top. Such a table is known from EP-A-0 198 610. If there the individual table is enlarged or even is to be made into an extended table, this is only possible in that at least one incomplete, as it were, table having only two legs is attached in an extension of the table. Thus a frame having three rails and two legs is required for each additional table top. Therefore this structure is only suitable for making a table longer, not for making extended tables of arbitrary shape. It also has not been provided to insert a leaf without legs between two individual tables. However, the latter is possible in EP-A-0 332 096. But it is considered disadvantageous in connection with this table that the frame rail must be welded together and this frame is placed on the four corner pieces of the individual table, to each of which a leg has been assigned. This frame construction is more expensive than the pluggable one of the first mentioned EP-A-0 198 610. Added to this is that with the table according to EP-A-0 332 096 it is necessary to place the table top on the frame. Protection of the table edges is not possible in this way.

In the table according to EP-A-0 198 610, the table top can be placed inside the frame, but only the two long edges are protected by the frame. However, in a table of a different type (DE-B-1 125 608) it is already known to reduce the frame rails in the form of steps on the inside of the frame and in this way to house the table top inserted in the frame and preferably flush at the top. In this case the table is glued together, and in particular forms a desk, which neither permits a building block method nor an enlargement, if necessary.

SUMMARY OF THE INVENTION

Thus it is the object of the present invention to provide a table of the above mentioned type in such a way that it can be used selectively as an individual table or an extended table while being simple to construct and having a visually advantageous look, where there are for all practical purposes no limits regarding the shape of the extended table and where the use of legless leaves is possible.

To attain this object the present invention provides a table with a table top inserted into a frame. The frame consists of corner pieces, each forming a corner frame, and frame rails connecting each two of the corner pieces, where a removable table leg is associated with each corner piece. The table top is supported on at least one frame rail, and the upper surface of the table top extends approximately flush with the top of the frame, where furthermore the rail height is reduced step-like at the inside of the frame. The table top rests on the reduced rail section, where the height of the frame step approximately corresponds to the thickness of the table top. In an individual table with a closed frame the height of all rails as well as all corner pieces, the height of which is essentially equal to that of all rails, is reduced in a step-like manner on the inside by the same amount, and that at least the corner pieces have two receptacles disposed at a angle to each other for one connecting piece each, where two frames directly assigned to each other are connected with each other by means of at least two connecting members. When an extended table is formed, at least two individual tables are connected directly or indirectly via a leaf, where the latter consists of a frame corresponding to that of an individual table, and a table top inserted therein. It is always possible to house the table top inserted and thus protected in a frame, regardless of whether it is an individual table or an extended table made of at least two individual tables or of individual tables and at least one leaf. If more than one individual table is required, it can quickly be enlarged by at least one further individual table or by at least one further individual table and a leaf, while the individual elements of the extended table can be securely connected by means of connecting members. This connection can be made quickly and, if needed, can also be undone.

Because each corner piece has two receptacles for a connecting element each placed at an angle to each other, it is possible to assign each angle leg an angle leg of another corner piece and then releasably connect these two angle legs by means of a connecting member. In this way it is theoretically possible to assign two corner pieces to one corner piece. But particular importance is lent to the two receptacles of a corner piece because of the fact that the "extension" of this individual table can be selectively assigned to the one or the other rail of this corner.

Furthermore, based on this frame construction in the manner known from the table which constitutes the species, it is possible to provide tables of different length by the use of rails of different length. Because the table top is protectively placed in the frame it can be made of delicate materials. It is therefore easily possible to use table tops of glass, stone, wood, plastic and similar materials. Because of the detachable legs and the removable table top there are no problems during shipping and packing. Because the legs are detachable, they can easily be exchanged for other ones.

The size of the table top is not determined by the interior clearance of the frame, instead it is larger in the longitudinal as well as the crosswise direction by the width of the step—measured in the horizontal direction—than the interior clearance of the frame. If it is intended that the table top should end flush with the frame at the top and be placed on support elements, this must be correspondingly considered in connection with the thickness of the table top, if the step-like reduction of the rail height has a preset size. For practical purposes the receptacle of the corner pieces is selected to be rectangular, so that a rectangular table top can be inserted, which can be manufactured more cost-effectively than a table top with rounded corners.

According to one variant of the present invention, the table is characterized in that the one rail piece is interlockingly connected with the other rail piece, and that the other rail piece has an approximately C-shape in cross section, where each free leg of the C engages a groove of the one rail piece and preferably forms an angle-shaped cross section.

According to another variant of the present invention, the table is characterized in that the rail consists of a metallic hollow profile as well as of solid profile, preferably of wood, enclosing it on the outside and partially at the top, where the table top rests on the free surface of the hollow profile and the preferably parallel edge of the solid profile is placed ahead of the edge of the table top.

According to another variant of the present invention, the table is characterized in that the two pieces of the rail are interlockingly connected with each other and are in particular additionally kept together via connecting elements.

According to another variant of the present invention, the table is characterized in that the corner piece is provided with a female thread and that a corresponding male thread is located at the associated upper end of the leg, and that the corner piece has on its underside a particularly conically tapering lug in which the female thread terminates outwardly and which slightly protrudes over the lower frame plane (25).

According to another variant of the present invention, the table is characterized in that the table leg is embodied as a cone on its upper end associated with the lug of the corner piece, where the cone of the leg engages a conical receptacle of the lug.

According to another variant of the present invention, the table is characterized in that the lower end of the table leg is also embodied conically, where the upper and the lower cones are approximately the same and the lower cone is provided with an axial female thread into which an adjustment leg can be screwed.

According to another variant of the present invention, the table is characterized in that the corner piece is embodied as a kind of a corner hinge with a hinge axis extending perpendicular to the table plane, where the two legs of the hinge preferably enclose an angle of approximately 60° to approximately 120° .

According to another variant of the present invention, the table is characterized in that connecting member is embodied as a hook or is provided with one, which engages a receptacle from above, where each connecting member is attached on a corner piece of the leaf, and the associated receptacle on the frame of the individual table, in particular on a corner piece of the individual table, or vice versa.

In a very advantageous manner the corner piece can be provided with a female thread, and a corresponding male thread is placed on the associated upper leg end, where the corner piece has on its underside a particularly conically tapering lug, in which the female thread terminates and which slightly protrudes over the lower plane of the frame. The leg can be unscrewed for shipping or if the table is not needed, because of which its space requirements are reduced. On the other hand, this connection between frame and legs speeds up the manufacture of the table. These lugs can be used as spacers when the tables are stacked after removal of the legs.

In a preferred embodiment of the invention the table leg is embodied conically on its upper end associated with the lug of the corner piece, where the cone of the leg engages a conical receptacle of the lug. In this way the leg is centered and held secured against rocking.

As a rule, tables, in particular tables for offices, schools and the like, are rectangular or square. In this case corner pieces are used which automatically assure a right-angled association with adjoining frame rails. However, there are also requirements for other table shapes, in particular if such a table is intended to be placed directly next to a table with the same or a different shape in order to achieve a quite particular shape of the entire table. To do justice to such requirements, too, a preferred variant of the invention provides that the corner piece is embodied in the form of a corner hinge with a hinge axis extending perpendicular to the plane of the table, the two legs of the hinge enclosing an angle of approximately 60° to approximately 180°. If the legs of this corner piece form a 90° angle with each other, this corner piece can be used for providing a frame for a rectangular or square table. If it is intended to make the table pentagonal, hexagonal or of other shapes, the angle enclosed by the two legs is selected to be correspondingly greater. With three corner pieces, each set to 60°, the formation of a triangular frame for a table with three legs is possible. But the corner pieces of a frame need not all be set at the same angle. These corner pieces can also be used for a table with no regular multicornered shape.

Another preferred embodiment of the invention is characterized by two cutouts of the frame rail, the lateral distance of which approximately corresponds to twice the distance of a receptacle of the corner piece from the outer edge of the corner piece. As already mentioned it is possible—in the normal case with equal table heights—to place a plurality of tables next to each other in order to obtain an extended table. If two individual rectangular tables are used, the extended table has eight legs. However, it is possible to create an extended table with the help of two individual tables and a leaf without legs inserted between them, which is larger by the area of the leaf than the total area of the two individual tables, but which only has a total of eight legs when two four-legged individual tables are used. It is advantageous to embody the leaf in the same way as the two table tops. Because of this, the production of individual parts, in particular of corner pieces, is increased, and cost-effective production is attained by mass production.

Because the leaf does not have legs of its own, its weight must be supported by the adjoining individual tables. Transfer of this weight takes place via the connecting members or at least one connecting member between each individual table and the leaf. The connecting members provide a direct connection between adjoining frame rails.

If two individual tables of at least the same width are connected with each other via a leaf, it is practical as a rule to choose the width of the leaf to be the same as that of the individual tables. On the other hand, the two individual tables must not absolutely have the same measurements, for example the same width, and the adjoining rails of the individual tables and the leaf also need not be of the same length. However, if the adjoining rails of an individual table and of the leaf are chosen with the same length, the two connecting members can be advantageously associated with the corner pieces, i.e. adjacent corner pieces can always be connected with each other via the intermediate members. In this case the additional connection of the rails is not required. On the other hand, though, this does not necessarily mean that the connecting members must be associated with the corner pieces.

A further embodiment of the invention is characterized in that connecting member is embodied as a hook or is provided with one, which engages a receptacle from above, where each connecting member is attached on a corner piece of the leaf, and the associated receptacle on the frame of the individual table, in particular on a corner piece of the individual table, or vice versa. Attachment of the connecting members to the leaf is given preference over the attachment to the frames of the individual tables. The connecting members each must be fixedly connected with their frames, while their hooks are only suspended from above in the associated receptacle of the other frame. No additional fixed connection is required there, because the hooks are firmly pressed into the receptacles by the weight of the frame and top to be suspended. Otherwise the receptacles must be embodied in such a way that lateral yielding is impossible either in the longitudinal direction of the connecting members or crosswise thereto.

A further variant of the invention is characterized in that each corner piece of the leaf and of the individual table has two receptacles disposed at right angles to each other for a hook and the connecting piece is provided at both ends with a hook of the same kind, where each receptacle is embodied as a groove open at the top, which is recessed step-like at its inner end for suspending one of the free ends of the connecting member. It permits the attachment of a leaf to each rail of the individual table. By means of this a universal table system is achieved, which makes many variants possible.

A further embodiment of the invention is characterized by a plug with fastening pegs, which can be inserted into the through-bore of the corner piece and which closes off the associated cutout for a connecting element in the corner piece flush with the exterior, while the step-like recess of the corner piece for receiving the corner of the table top remains free.

Another advantageous embodiment of the invention is characterized by at least one cutout for a connecting element on at least one frame rail, in particular in the center section of an individual table which is used with the cutout of a corner piece a pair of cutouts for fastening a connecting member each of a leaf or for receiving a hook each of a connecting member. It permits lateral attachment of a leaf to an individual table where the associated or adjoining rails of the leaf and the individual table are of different length. One connection of the two rails can be provided in the area of the corner pieces associated with each other, while the second connection takes place in the area of the other corner piece and of the cutout disposed on a fixed location of the rail. This is an additional cutout, i.e. one or at least one cutout is located not only on this rail, but also on the two associated corner pieces.

For example, in order to be able to support two leaves, which are disposed next to each other and which directly adjoin each other, on one long side of a rectangular table, a further embodiment of the invention is characterized by two cutouts in the frame rail, the lateral distance of which corresponds to approximately twice the distance of a cutout of the corner piece from the outer edge of the corner piece. In the example mentioned, the two frame rails, which are placed one in the extension of the other, of the two leaves may together have the same length as their associated longitudinal rail of the individual table.

To avoid special shapes of the rails, a further embodiment of the invention provides that the two cutouts are located on a center section of a rail consisting of three rails which can be rigidly connected with each other. This center rail section, in particular provided with two cutouts, in principle corresponds to a corner piece with only the difference that in place of two angled connections it has two parallel ones.

To make possible special shapes of an extended table, for example a horseshoe shape or a special round shape, a further variant of the invention provides that at least one of the rails has the shape of a bow. For example, it can be constructed of three rigidly connected partial sections or in one piece. The idea in particular is to use a table top which in plan view is approximately C-shaped. In this case the bow-shaped rail is associated with a table edge of the same shape. The other rails can extend in a straight line. It is also conceivable that in a further embodiment of the invention two parallel rails each have a bow-shaped form, these bows being disposed parallel. In this connection "parallel" is understood to be a disposition where the center sections of the bows extend parallel to each other and the legs of the bows each point in approximately the same direction. The connection of the right with the left ends of the legs of the bows can take place by means of a straight rail.

Particularly varied shapes of extended tables can be put together by the corner piece embodied as a corner hinge, consisting of two essentially equal parts which can be displaced around the hinge axis in respect to each other, having set-off legs and a threaded bore which is concentric in respect to the hinge axis or a through-bore for the threaded stem of the leg. In this way it is possible to set practically arbitrary angles at the corner hinges, in which case of course the table tops can be irregular polygons having the corresponding angles.

For assembly, the portions of the corner piece embodied as a hinge can each be partially inserted in the frame rail and for locking there they can be divided into two partial legs which can be resiliently spread apart by means of a spreader screw.

Attachment of side tables at practically arbitrary locations can be made possible in that at least a portion of the rails have on at least one side a longitudinal groove which in cross section is undercut and in which a connecting member is displaceably guided, the connecting member supporting the free end of a rail of a leaf. Connection at an arbitrary angle can be achieved in a particularly advantageous manner in that the connecting member has a partial leg pivotable around a perpendicular hinge axis, where in an advantageous manner this partial leg also can be split into two parts which can be resiliently spread apart by means of a spreader screw so that in this way they are securely fixed in the end of the rail.

To be able to insert a connecting member at an arbitrary location of the rail having a longitudinal groove, a guide member displaceable in the longitudinal groove can be made of two parts, divided perpendicular to the hinge axis, where these two parts can then be individually introduced through the opening of the undercut longitudinal groove and can then be pushed on each other and then kept together by means of a screw or the threaded stem of a leg.

In a practical manner the screw holding the two parts together can be used simultaneously as the hinge for the partial leg which is adjustable around the hinge axis. For this purpose the partial leg can have two guide protrusions, which are received towards the interior in receiving grooves of the two parts of guide element, where these guide protrusions are preferably embodied rotationally symmetrical with respect to the axis of rotation.

BRIEF DESCRIPTION OF THE DRAWINGS

The invention will be described in detail by means of the attached drawings. The drawings illustrate various exemplary embodiments of the invention.

FIGS. 4 to 8 are plan views of various other shapes of tables in a slightly reduced scale compared to FIG. 2, FIGS. 9 to 15 are schematic plan views of extended tables constructed from a plurality of individual tables in even greater reduction, FIGS. 22 to 26 are various embodiments of the table frame in cross section, FIG. 27 is a lateral view, and FIG. 28 is a front view of a plug installed in place of the connecting piece shown in partial section in FIG. 21, FIG. 29 is a front view of a corner of the frame in the corner hinge in enlargement, FIG. 30 is a plan view of FIG. 29 in another swiveled position of the corner hinge.

DESCRIPTION OF THE PREFERRED EMBODIMENTS

Figure 1:
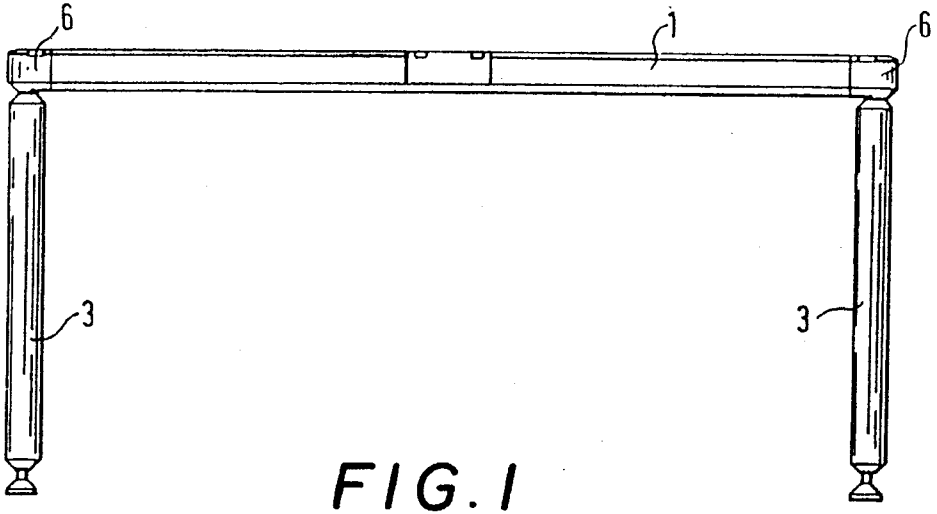
FIG. 1 is a lateral view of a table.

The table 1 or individual table consists as a frame 1, a table top 2 inserted therein as well of at least three legs 3. However, preferably these are tables with four legs. All legs are removable, they preferably can be unscrewed in the exemplary embodiments. For this purpose they have on their ends which are oriented towards the frame 1 a threaded stem 4 which is screwed into a threaded bore 5 of a corner piece 6 of the frame. The opposite arrangement is also conceivable, namely the application of a threaded stem on the corner piece and of a threaded bore on the leg.

The frame consists of corner pieces 6 and frame rails 7 inserted between each two corner pieces. Thus the frame of a four-cornered table consists of four corner pieces and four rails. If it is a rectangular table as in the exemplary embodiments 1 to 3, it has two long rails and two short rails. As can be seen in FIGS. 23 to 26, for example, the table top 2 is inserted into the frame in such a way that the surface 8 of the table top 2 extends flush or at least approximately flush with the top 9 of a rail piece 16 of the frame. It can furthermore be seen in these drawing figures that the table top is supported at least on the frame rails, the support being preferably directly on the frame rails. It can be seen in FIG. 18 that by means of the appropriate embodiment of the corner pieces the table top can also be supported on them. This requires that there be a recess 10 running around the inside (FIG. 22), which also extends over the corner pieces and which preferably has the same dimensions in the area of the corner pieces as in the area of the rails. The recess 10 is produced by the rail height 11 being reduced step-like on the inside of the rail or the inside of the frame. The table top 2 rests on the reduced rail piece 12, while the higher rail piece 13 encloses the table top to form the table edge.

Figure 22:
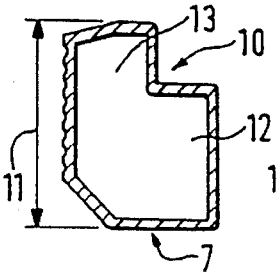

While the term "reduced height" is used here, this does not necessarily mean that the rail has been worked, rather that it can be an appropriately shaped profile as shown by way of example in FIG. 22. From FIGS. 23 to 26 it can be seen that the height of the frame step or recess 10 approximately corresponds to the thickness of the table top or, with a table top of uneven thickness, to the edge of the table top.

Figure 3:
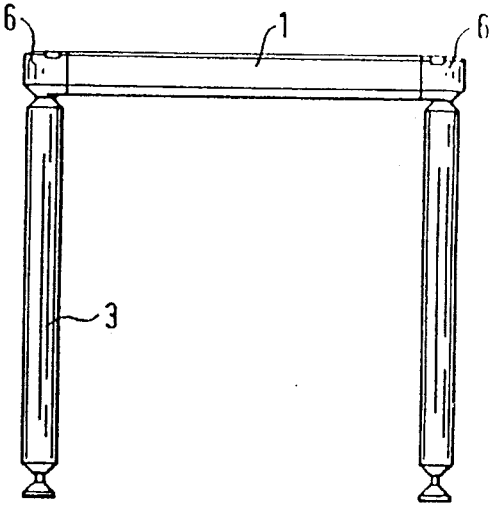
FIG. 3 is a lateral view of the narrow side of the table of FIG. 1.

It can be seen, for example, from FIGS. 1 and 3 that the height of the frame rails—measured in the perpendicular direction—is equal or at least approximately equal to the height of the corner pieces. This can also be seen for example in the enlarged view of FIGS. 16 and 17. The angled recess of the corner piece 6 (FIG. 18) is indicated by 14.

Figure 21:
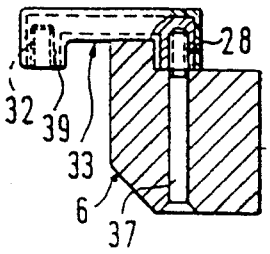
FIG. 21 is a cross section of the corner piece.

While the corner piece 6 in accordance with FIG. 21 consists of solid material, the rail 7 of FIG. 22 is a section of a hollow profile. In contrast thereto the rails of FIGS. 23 to 26 are made in two pieces. The division is provided in the longitudinal direction, i.e. both rail pieces are of equal length. In accordance with FIGS. 23 and 24, the rail is essentially made of a specially shaped hollow profile, for example of aluminum, forming the one rail piece. This rail piece alone is responsible for the stability of the frame 1. The respectively other rail piece 16 of this rail structure primarily has an esthetic effect. It is made of a plastic profile strip, preferably of plasticized PVC. Although in accordance with FIG. 24 the table top 2 of the inside of the frame extends flush with the frame, the outer frame edge of this variant has been raised a little, so that liquids cannot run over the table edge.

Figure 23:
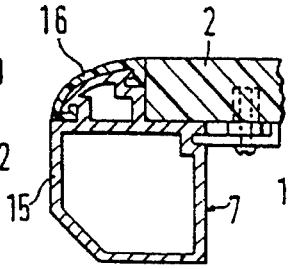
Figure 24:
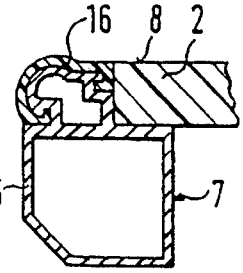
Figure 31:
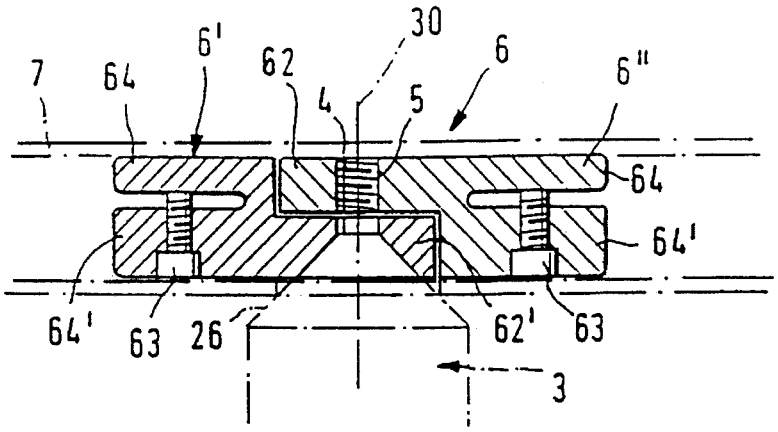
FIG. 31 is a partial view of a connecting piece settable at an angle.
Figure 32:
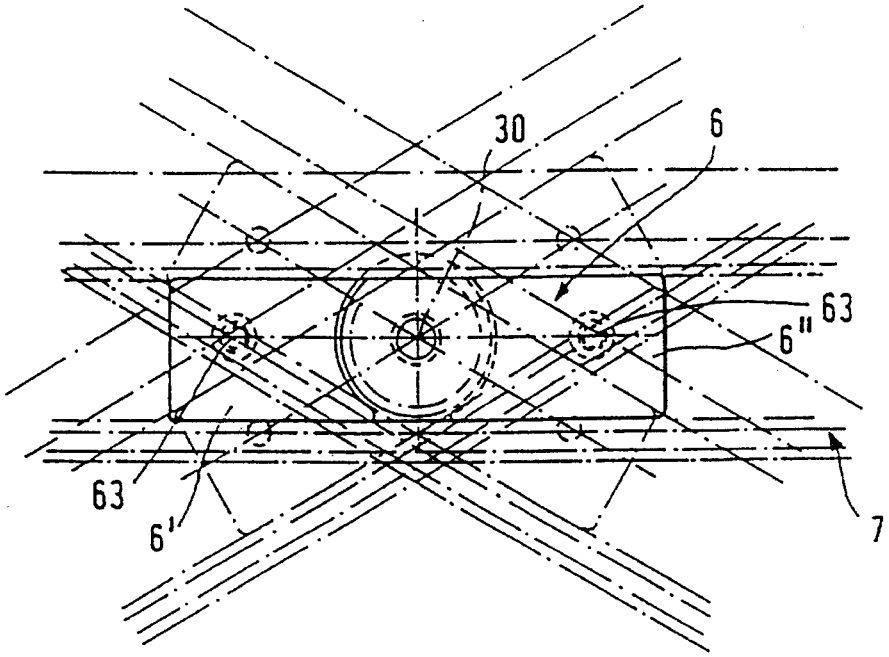
FIG. 32 is a schematic view showing different angular positions of the corner hinge.
Figure 33:
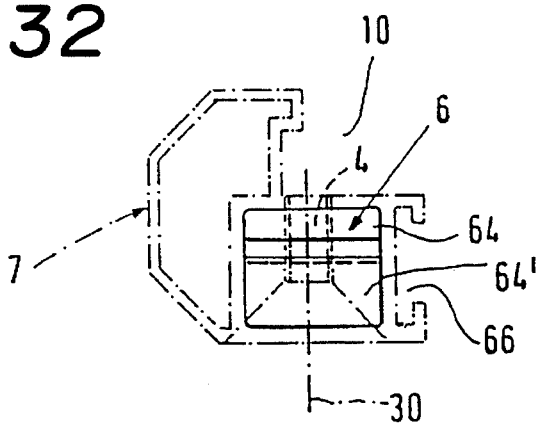
FIG. 33 is a schematic view in elevation of a corner hinge configuration.
Figure 34:
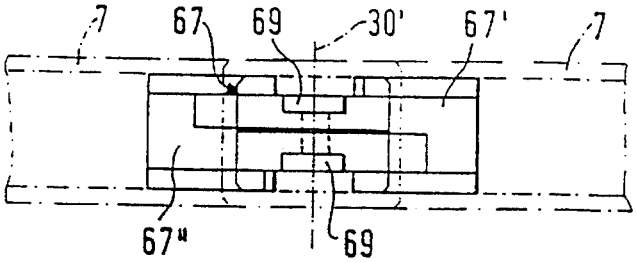
FIG. 34 is a schematic view of two adjacent rails and their connecting member.
Figure 35:
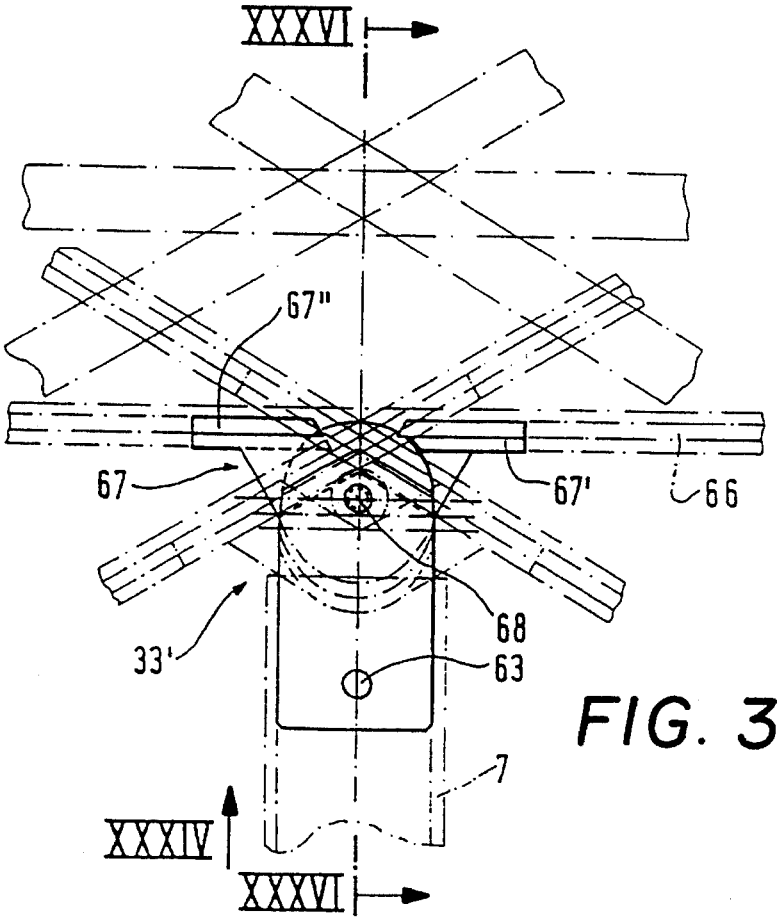
FIG. 35 is a schematic top view showing different positions of the guide element.
Figure 36:
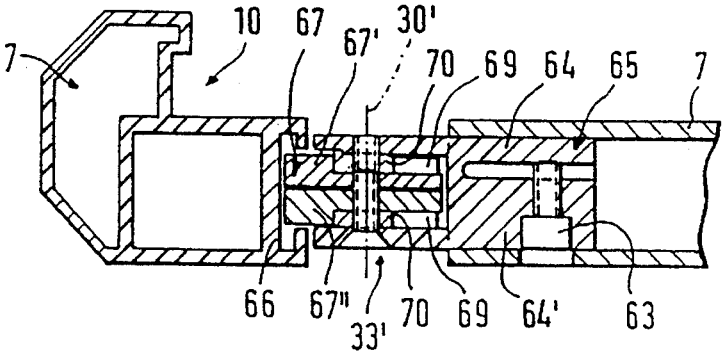
FIG. 36 is a cross sectional view of two adjacent rails and their connecting member.

The two rail pieces 15 and 16 of FIGS. 23 and 24 are interlockingly connected with each other, so that even under a somewhat increased load the rail piece 16 cannot separate from the rail piece 15. In these variants the other rail piece 16 has an essentially C-shaped cross section, where each of the ends of the C-shaped legs are embodied to be hook-like. Each one of these free, hook-like C-shaped legs engages a groove of the rail piece 15. The two rail sections are pushed one on the other by pushing the smaller strip-shaped rail piece 16 in a longitudinal direction on the larger rail piece 15, which in a practical way is made as an aluminum profile. In accordance with FIGS. 25 and 26, the rail 7 may also be constructed from a metallic hollow profile and a solid profile rigidly connected therewith, where the hollow profile forms the one rail piece 15 and the solid profile the other rail piece 16. It is intended in particular in these two exemplary embodiments for the one rail piece 15 to be an aluminum profile, while the other rail piece 16 is made of wood. In this case the recess 10 is formed by both rail pieces together, while in the embodiments of FIGS. 23 and 24 it is primarily determined by the rail piece 15. In both cases the table top 2 rests on the upwardly oriented surface 17 of the one rail piece 15. The edge 19 of the solid profile of the other rail piece 16, oriented towards the interior of the frame and preferably parallel to the table top edge is, if possible, placed directly in front of the latter.

In the exemplary embodiments of FIGS. 25 and 26, the connection of the two rail pieces 15 and 16 is provided with the aid of a plurality of screws 20, disposed offset in the longitudinal direction, which are screwed into threaded bushings 21. The latter are maintained fixed against rotation in the other rail piece 16. For example they are pressed in. The screw 20 extends through two bores, aligned with the thread of the bushing 21, in the parallel rail walls of the one rail piece 15.

It can also be seen from FIGS. 25 and 26 that the two rail pieces 15 and 16 are interlockingly connected with each other. This can be achieved, for example, by forming two parallel strips 22 and 23 on the hollow profile of the one rail piece 15, which engage in appropriately disposed grooves of the solid other rail piece 16.

Figure 16:
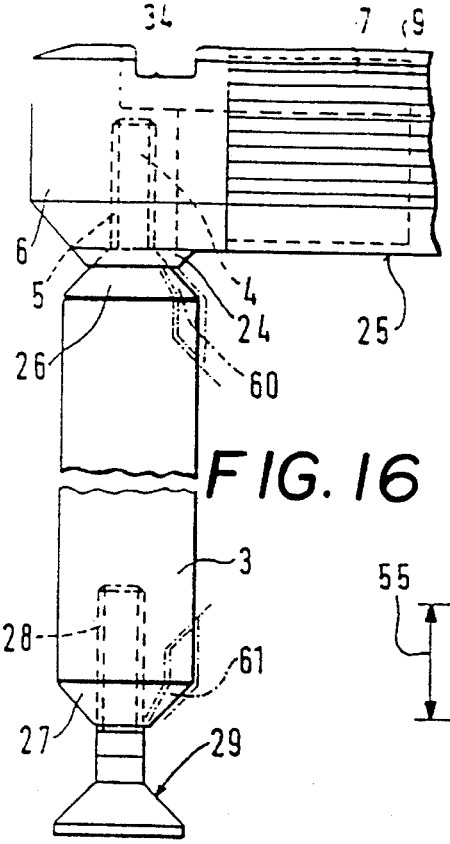
FIG. 16 is a fragmentary lateral view in the area of a table leg in an enlarged scale.
Figure 17:
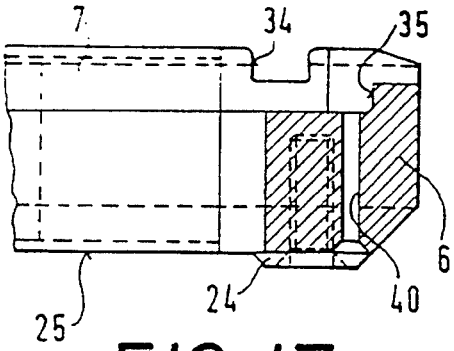
FIG. 17 is a fragmentary lateral view, partially cut in a perpendicular direction, of the table of FIG. 16.

By way of example it can be seen from FIGS. 16 and 17 that the corner piece has on its underside a lug 24, particularly tapering conically, in which the female thread 5 terminates on the outside. In the exemplary embodiments this lug extends slightly, i.e. by a few millimeters, beyond the lower plane 25 of the frame.

On its upper end associated with this lug 24 of the corner piece 6, the table leg 3 is embodied conically, this cone being designated by 26. In the exemplary embodiment (FIG. 16), the free cone surfaces and the cone height have been selected to be of different size. It has been provided in particular that the leg cone 26 engages the opposite cone of the lug 24, which widens towards the outside, and is centered in this way and securely maintained.

The lower end of the table leg 3 is also embodied conically, this cone being designated by 27. Preferably at least the cone angles of the two leg cones 26 and 27 are of the same size. The height of the lower cone 27 in FIG. 16 is of approximately the same size as that of the upper cone 26. On the lower end of the leg 3 a female thread 28 is centered through the cone 27 and extends into the nonreduced cross section of the leg. It is used for screwing in an adjustment leg 29 for adjusting the height of the table.

While the corner pieces of the above described variants of the table determine a solid angle for the rails to be connected which, in a preferred manner is a right angle, the corner piece in accordance with FIGS. 29 and 30 is embodied as a type of a corner hinge. The hinge axis 30 extends perpendicular to the plane of the table top 2. In the exemplary embodiment, the angle 31 formed by both legs of this corner piece can be changed over a large range of, for example approximately 60° to approximately 120°.

Each corner piece 6 is equipped with two receptacles 34, placed at right angles to each other, for a connecting member 33. These connecting members, preferably a pair of connecting members, are used for the rigid connection of the table top 2 of the table with a further top, which can be a further table top or a leaf 36 placed between two individual tables, which will be discussed in more detail below. The receptacles 34, 35 in accordance with FIG. 17, for example, are in the form of a longitudinal slot open at the top and side, which is recessed at its inner end in a step-like way. A hook portion of a connecting member 33 engages this recess. After the connecting member 33 in accordance with FIG. 21 has been connected with the corner piece via a screw 37 or in another known manner, and is furthermore embodied symmetrically with respect to a perpendicular cross center plane, it is sufficient if two connecting members are rigidly mounted on only one of the two associated rails of the two table tops. The free projecting ends, namely the hooks 32, are simply suspended from above at the other table top. This connection is securely maintained by reason of the weight of the suspended table top alone, where it is unimportant whether or not legs have been attached to the suspended table top. It can further be seen in FIG. 21 that the connecting member 33 extends flush or at least approximately flush with the top of the corner piece 6 and preferably with the top of the entire frame 1. In this way the width and depth as well as the step-like recess of the receptacles 34 and 35 follow the corresponding dimensions of the connecting member 33.

In the exemplary embodiment, the screw 37 is screwed in one of two parallel female threads 38, 39. If the table top with the connecting members is only suspended in the frame of the other table top, the female thread 39 remains unused. On the other hand it would also be possible to make a connection there with the aid of a screw, if all corner pieces are embodied the same and thus each has a receiving bore 40 for the fastening screw.

FIGS. 4 to 8 show that the table top 2 does not necessarily have to be square or rectangular. Four-legged tables are easily conceivable having a roughly C-like shape 43 or 44 deviating from the square shape 41 or the rectangular shape 42. The same corner pieces 6 can be used with the table shapes 43 and 44 as with square or rectangular tables. With these variants the rails 45 and 46 do not extend parallel, but angled, in respect to each other. Additionally, at least one of the rails connecting these two straight rails 45 and 46 with each other is bow- or U-shaped. With the embodiments according to FIGS. 4 and 5 the two rails 47 and 48 have an approximately U shape, where each of the two left and two right legs extend parallel to each other and perpendicular to the associated straight rail 45 or 46.

The table shapes in accordance with FIGS. 4 and 5, but also the approximately triangular table in accordance with FIG. 6, can be parts of an extended table. Different variants of such an extended table ensue from FIGS. 9 to 15. For example, the extended table in accordance with FIG. 9 consists of two tables according to FIG. 5 and three tables according to FIG. 8. In this case it is not necessarily required that the two tables in accordance with FIG. 5 themselves have legs, instead they can comprise leaves 49 and 50. Their frames are constructed in the same way as the frames of the tables 41, 42 of corner pieces and rails 7 placed between adjacent corner pieces. Furthermore, the table top 2 has been inserted recessed in each one of these frames. The connection between two adjoining tables is made in the manner described above by means of at least two connecting members 33 between adjoining table tops, where each of the connecting members is advantageously fastened on the leaves 49 or 50.

Whether such an extended table is constructed of a plurality of individual tables with legs or only partly of individual tables and partly of at least one leaf 49, 50, depends on the one hand on the conditions and partially also on the total shape of the extended table. Thus it is recommended in connection with the table in FIG. 3, for example, to provide at least one pair of legs at least at the ends of the tables facing each other.

If the individual table is not connected with another individual table or with a leaf 49, 50, no connecting members 33 are needed. In this case it is advantageous if the receptacles 34, 35 can be closed off by means of a plug 51 (FIG. 27). The plug 51 has a fastening peg 52 which allows a pluggable connection with the receiving bore 40 of the corner piece 6. Otherwise the shape of the plug 51 is chosen to correspond to that of the receptacle 34 or 35, so that the plug can completely close off the receptacle in the corner piece 6 and a surface level at the top is created.

Figure 2:
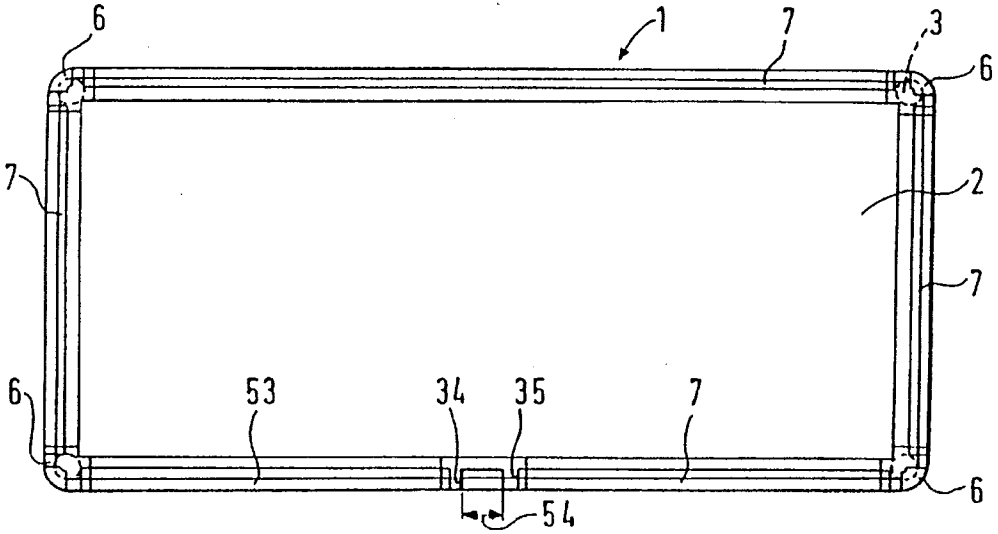
FIG. 2 is a plan view of a table of FIG. 1.
Figure 18:
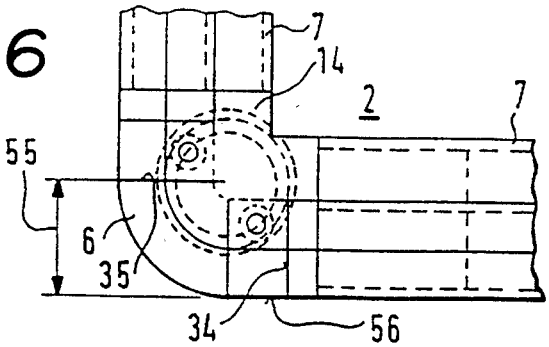
FIG. 18 is a plan view of the table corner shown in FIG. 16.

If, for example, it is intended to connect a shorter table or the narrow side of another individual table or a leaf 36 in an off-centered way with the long side of an individual table, it is easy to make the connection at this place in the manner described with corner pieces of the two frames which are associated with each other. The other corner piece 6 of the short rail, however, can only be connected with the longer rail via a connecting member, if this rail has a receptacle 34 (FIG. 2) at the associated place, for example in its center area, which corresponds in its design to one of the two receptacles 34, 35 of the corner piece. A particularly advantageous possibility for the right angle connection of rectangular tables of, for example, the same size, or of an individual table and a leaf, can be achieved in accordance with FIG. 2, if the longitudinal rail 53 has two receptacles 34, 35 disposed parallel and at a distance from each other. In this way it is possible to associate the second individual table or the leaf 49, 50 either with the rail part which is to the left in FIG. 2 or to the right rail part of the rail 53. Even the connection of the individual table of FIG. 1 with two further individual tables or leaves disposed parallel to each other is conceivable. In FIG. 2 the lateral distance 54 of the two receptacles 34 and 35 is approximately twice as great as the distance 55 of a receptacle 34 or 45 from the outer edge 56 of the corner piece (FIG. 18).

It is now possible to dispose the two receptacles 34, 35 directly on the appropriate rail 53 or create a special straight intermediate piece corresponding to the corner piece 6, so that the rail 53 consists of three parts, namely the intermediate piece, in particular center piece, having the receptacles 34 and 35, and two rail pieces disposed to the left and right thereof. The two free ends of the latter are then each connected with a corner piece 6. The connection of the three rail pieces must assure sufficient load capacity of this rail.

Figure 19:
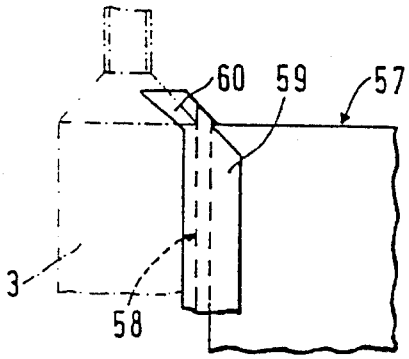
FIG. 19 is a fragmentary front view of a cover with an associated leg end.
Figure 20:
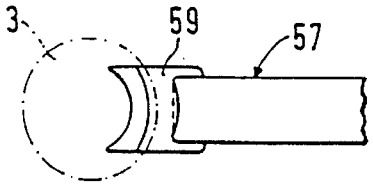
FIG. 20 is a plan view of FIG. 19.

In FIGS. 19 and 20 it can be seen, mostly indirectly, that it is possible to dispose a plate 57 for use as a cover between two adjoining table legs 3. Its perpendicular length facing the leg 3 encompasses the respective leg from the inside to the outside in accordance with FIGS. 19 and 20. In the case of a circular cross section of the leg, the long edge is in the shape of an arc of a circle. Because of this the plate can easily absorb forces directed crosswise to its surface. In the exemplary embodiment this perpendicular long edge is not formed directly on the plate, but on a profiled strip 59 fixedly connected with it, for example glued. In a practical manner this is a profiled plastic strip.

In accordance with the illustration of FIG. 19 in connection with FIG. 16, the profiled strip 59 has been provided at its upper and lower ends with a protrusion 60 or 61 in the shape of a barb pointing away from the plate. In this case the upper protrusion 60 overlaps the upper cone 26 of the leg 3 from above, while the protrusion 61 overlaps the lower cone 27 of the leg 3 from below.

In this way the plate 57 is not only securely maintained crosswise to its plane, but also in the perpendicular direction, without special fastening elements. It can be mounted as easily as it can be removed.

A connecting member 33' is shown in FIGS. 31 to 36 which is guided longitudinally displaceable in a longitudinal groove 66 of a rail 7 with a guide element 67. This connecting member 33' is made of several pieces. It consists of the guide element 67 composed of two parts 67', 67'' and a partial leg 65 which is partially received in the rail 7 and for fastening is split into partial legs 64 and 64', which can be spread in the rail 7 with the help of a spreader screw 63.

The two parts 67', 67'' of the guide element 67 have receiving grooves 69 extending crosswise to the longitudinal groove 66, in which guide protrusions 70 of the partial leg 65, which is spread in this location, are received. The partial leg 65 is pivotable via a screw 68 with respect to the guide element 67 around the pivot axis 30'.

In place of the screw 68 it is also possible to screw in an appropriately embodied threaded stem 4 of a leg 3 to receive the perpendicular load of the rail 7.

Figure 37:
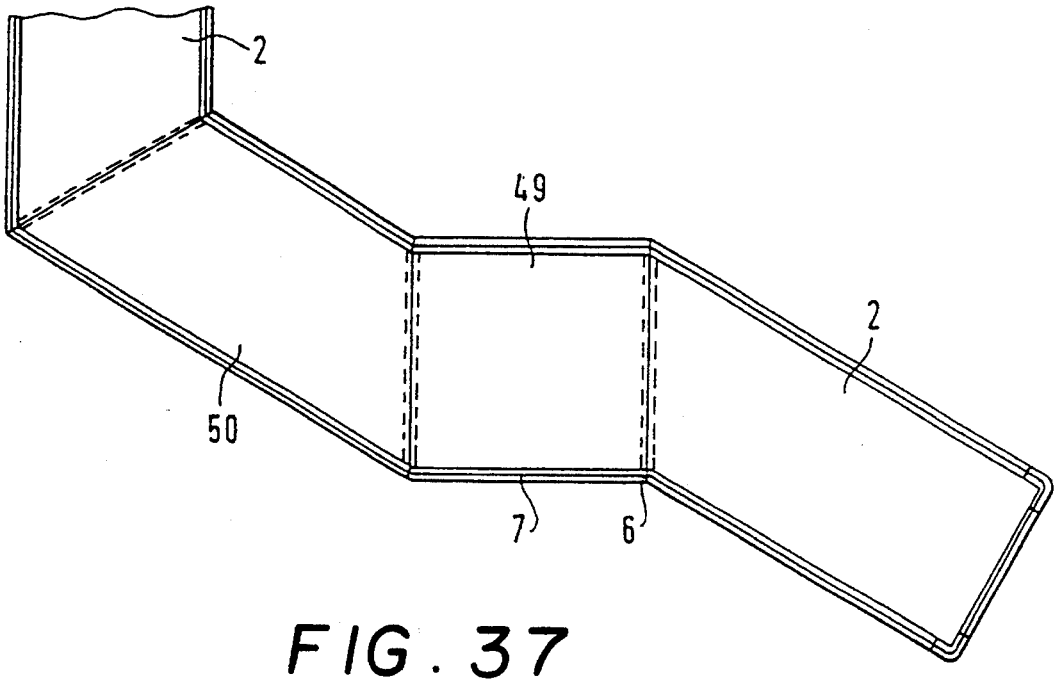
FIGS. 37 and 38 are two embodiments of extended tables.
Figure 38:
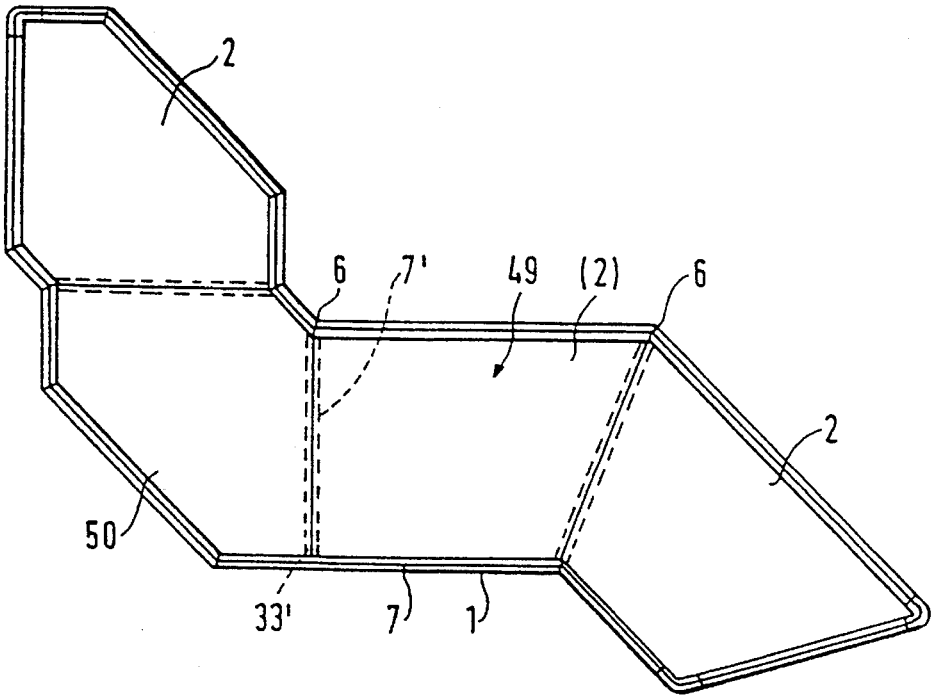

Using the connecting members 33' embodied in accordance with FIGS. 31 to 36, it is possible to assemble an extended table composed of a plurality of table tops 2 and leaves 49, 50 in practically any arbitrary shape, as illustrated in FIGS. 37 and 38. It is then possible to embody the table tops 2 or the leaves 49, 50 in an appropriate polygonal shape and the required frames 7 can be adapted. By means of the embodiment of the corner pieces 6 as hinges or with the connecting members 33', which can be set at an angle, practically any shape for the extended table can be realized, and only a few different individual parts are required.

I claim:

1. A table, comprising:

a frame including a plurality of rails and a plurality of corner pieces joined to the plurality of rails;

a leg removably associated with each corner piece; and a table top having a top surface and a recess engaging portion, wherein:

each rail consists of a pipe-shaped hollow profile; and each rail and corner piece defines a top surface and each corner piece and at at least two facing rails are formed with a step-like recess of equal height, such that when the rails and corner pieces are assembled as a frame, at least two parallel, continuous step-like recesses are formed which receive the corresponding recess engaging portions of the table top so that the top surface of the table top is flush with at least a portion of the top surface of the assembled rails and corner pieces.

2. A table, comprising:

a frame including a plurality of rails and a plurality of corner pieces joined to the plurality of rails;

a leg removably associated with each corner piece; and a table top having a top surface and a recess engaging portion wherein:

each rail and corner piece defines a top surface and each corner piece and at at least two facing rails are formed with a step-like recess of equal height, such that when the rails and corner pieces are assembled as a frame, at least two parallel, continuous step-like recesses are formed which receive the corresponding recess engaging portions of the table top so that the top surface of the table top is flush with at least a portion of the top surface of the assembled rails and corner pieces;

each corner piece is provided with a female thread upper end of each associated leg is provided with a corresponding male thread; and each corner piece has on its underside a particularly conically tapering lug in which the female thread terminates outwardly, said lug slightly protruding over the lower surface of adjacent rails.

3. A table in accordance with claim 2, further wherein each said lug includes a conical receptacle, each table leg is embodied as a cone on its upper end associated with said lug of the corner piece, and wherein the cone of the leg engages the conical receptacle of said lug.

4. A table in accordance with claim 3, further wherein each leg includes an adjustment leg portion, the lower end of the table leg is also embodied conically, where the upper and the lower cones are approximately the same and the lower cone is provided with an axial female thread into which the adjustment leg portion can be screwed.

5. A table, comprising:

a frame including a plurality of rails and a plurality of corner pieces joined to the plurality of rails;

a leg removably associated with each corner piece; and a table top having a top surface and a recess engaging portion, wherein:

each rail and corner piece defines a top surface and each corner piece and at at least two facing rails are formed with a step-like recess of equal height, such that when the rails and corner pieces are assembled as a frame, at least two parallel, continuous step-like recesses are formed which receive the corresponding recess engaging portions of the table top so that the top surface of the table top is flush with at least a portion of the top surface of the assembled rails and corner pieces;

at least one corner piece is embodied as a kind of a corner hinge with a hinge axis extending perpendicular to the table plane; and the two legs of the hinge extending from said hinge axis preferably enclose an angle of approximately 60° to approximately 120°.

6. A table, comprising:

a frame including a plurality of rails and a plurality of corner pieces joined to the plurality of rails;

a leg removably associated with each corner piece;

a plurality of connecting members;

a plurality of connecting means; and a table top having a top surface and a recess engaging portion, wherein:

each rail and corner piece defines a top surface and each corner piece and at at least two facing rails are formed with a step-like recess of equal height, such that when the rails and corner pieces are assembled as a frame, at least two parallel, continuous step-like recesses are formed which receive the corresponding recess engaging portions of the table top so that the top surface of the table top is flush with at least a portion of the top surface of the assembled rails and corner pieces, and each corner piece has two receptacles disposed at right angles to each other, said receptacles of each corner piece being adapted to receive a connecting member which is connected thereto by one of said connecting means for connecting an assembly of rail and corner pieces to another assembly of rail and corner pieces.

7. A table in accordance with claim 6, further comprising:

a leaf, further wherein:

said leaf is connected to an assembly of rail and corner pieces by at least two connecting members which are connected to the assembly of rail and corner pieces and to said leaf by said connecting means.

8. A table in accordance with claim 7, further comprising:

at least two corner pieces for each leaf, further wherein each connecting member includes a hook, which engages a receptacle disposed in a corner piece of said leaf, and wherein each connecting member is attached to a corner piece of the leaf and the associated receptacle on the corner pieces of said frame of the individual table by said connecting means.

9. A table in accordance with claim 8, further wherein: each corner piece of the leaf and of the frame of the individual table has two receptacles disposed at right angles to each other, the connecting member being provided at both ends with a hook of the same kind, and wherein each receptacle is embodied as a groove open at the top, which is recessed step-like at its inner end for receiving one of the hooks of a connecting member.

10. A table in accordance with claim 9, further wherein: each connecting member extends, at its top, approximately flush with its associated corner piece, and wherein the two rails associated with each corner piece are associated in close proximity with each other.

11. A table in accordance with claims 9 or 10, further wherein: a female thread is located at one end of each hook of each connecting member, and wherein each corner piece has a through-bore extending crosswise to the frame plane for receiving a fastening screw.

12. A table in accordance with claim 7, further wherein at least one cutout is provided for a connecting member on at least one frame rail substantially at the center section of an individual table, said at least one cutout being used with the cutout of a corner piece for fastening a connecting member of a leaf or for receiving a hook of a connecting member.

13. A table in accordance with claim 12, further wherein: the lateral extent of two cutouts of the frame rail, approximately corresponds to twice the extent of a receptacle of the corner piece from the outer edge of the corner piece.

14. A table in accordance with claim 13, further wherein: two receptacles are located on a center section of a rail having three parts.

15. A table in accordance with claim 7, further wherein: at least a portion of the rails have on at least one side a longitudinal groove undercut in cross section, in which a connecting member is displaceably guided, and wherein the connecting member supports the free end of a rail of a leaf.

16. A table, comprising:

a frame including a plurality of rails and a plurality of corner pieces joined to the plurality of rails;

a leg removably associated with each corner piece;

a plate used as a cover located between adjacent table legs, whose perpendicular long edges partially enclose the associated leg from the inside to the outside; and a table top having a top surface and a recess engaging portion, wherein:

each rail and corner piece defines a top surface and each corner piece and at at least two facing rails are formed with a step-like recess of equal height, such that when the rails and corner pieces are assembled as a frame, at least two parallel, continuous step-like recesses are formed which receive the corresponding recess engaging portions of the table top so that the top surface of the table top is flush with at least a portion of the top surface of the assembled rails and corner pieces, and each perpendicular long edge of the table legs is formed by a free long edge of a separately manufactured profiled strip connected with the plate.

17. A table in accordance with claim 16, further wherein the profiled strip has a protrusion on each of its upper and lower ends pointing away from said plate, which overlaps an associated cone at the upper or lower end of the leg from above or below.

* * * * *